US008167460B2

(12) United States Patent
Chu

(10) Patent No.: US 8,167,460 B2
(45) Date of Patent: May 1, 2012

(54) LED LAMP HAVING HEAT RADIATING HOUSING

(76) Inventor: Yu-Lin Chu, Tainan (TW)

( * ) Notice: Subject to any disclaimer, the term of this patent is extended or adjusted under 35 U.S.C. 154(b) by 289 days.

(21) Appl. No.: 12/577,947

(22) Filed: Oct. 13, 2009

(65) Prior Publication Data

US 2010/0301724 A1 Dec. 2, 2010

(30) Foreign Application Priority Data

Jun. 1, 2009 (TW) ..... 98118094 A

(51) Int. Cl.
*F21S 4/00* (2006.01)
*F21V 29/00* (2006.01)
*H01R 33/22* (2006.01)

(52) U.S. Cl. ..... 362/294; 362/373; 362/547

(58) Field of Classification Search ..... 362/545, 362/547, 218, 294, 373, 646, 650, 649
See application file for complete search history.

(56) References Cited

U.S. PATENT DOCUMENTS

| | | | | |
|---|---|---|---|---|
| 6,982,518 | B2 * | 1/2006 | Chou et al. | 313/46 |
| 7,303,301 | B2 * | 12/2007 | Koren et al. | 362/294 |
| 7,631,987 | B2 * | 12/2009 | Wei | 362/294 |
| 7,708,452 | B2 * | 5/2010 | Maxik et al. | 362/650 |
| 7,748,870 | B2 * | 7/2010 | Chang et al. | 362/294 |
| 7,758,223 | B2 * | 7/2010 | Osawa et al. | 362/547 |
| 7,784,969 | B2 * | 8/2010 | Reisenauer et al. | 362/294 |
| 7,824,077 | B2 * | 11/2010 | Chen et al. | 362/294 |
| 2007/0091597 | A1 * | 4/2007 | Wang et al. | 362/231 |
| 2007/0230186 | A1 * | 10/2007 | Chien | 362/294 |
| 2007/0253202 | A1 * | 11/2007 | Wu et al. | 362/294 |
| 2008/0158887 | A1 * | 7/2008 | Zhu et al. | 362/294 |
| 2009/0079321 | A1 * | 3/2009 | Liang | 313/323 |

* cited by examiner

*Primary Examiner* — Ismael Negron
(74) *Attorney, Agent, or Firm* — Alan Kamrath; Kamrath IP Lawfirm, PA

(57) ABSTRACT

A lamp includes a housing unit and a light source mounted on the housing unit. The housing unit includes a housing and a plurality of heat radiating fins. The light source includes a support base having a first side provided with a plurality of light emitting members, a heat radiating assembly having a first end mounted on a second side of the support base and a heat conducting plate mounted on a second end of the heat radiating assembly.

16 Claims, 7 Drawing Sheets

LED LAMP HAVING HEAT RADIATING HOUSING

BACKGROUND OF THE INVENTION

1. Field of the Invention

The present invention relates to a lamp and, more particularly, to a light emitting diode (LED) lamp.

2. Description of the Related Art

A conventional light emitting diode (LED) lamp comprises a housing and a light source mounted in the housing. However, the connection between the light source and the housing is a planar face so that the heat produced by the light source is easily concentrated on the connection between the light source and the housing and cannot be dissipated easily and rapidly, thereby easily breaking and decreasing the lifetime of the lamp due to a high temperature.

BRIEF SUMMARY OF THE INVENTION

In accordance with the present invention, there is provided a lamp, comprising a housing unit and a light source mounted on the housing unit. The housing unit includes a housing and a plurality of heat radiating fins mounted on the housing. The light source includes a support base having a first side provided with a plurality of light emitting members exposed outwardly from the receiving chamber of the housing, a heat radiating assembly having a first end mounted on a second side of the support base and a heat conducting plate mounted on a second end of the heat radiating assembly.

The housing of the housing unit has an inside provided with a receiving chamber, and the light source is received in the receiving chamber of the housing. The receiving chamber of the housing has an end provided with an opening, and the support base of the light source is located in the opening of the receiving chamber. Each of the heat radiating fins of the housing unit has an end provided with a pointed portion, and the support base of the light source is surrounded by the pointed portions of the heat radiating fins. The second side of the support base has a peripheral wall provided with a heat conducting groove to receive the first end of the heat radiating assembly. Preferably, the support base of the light source has a substantially convex shape. Preferably, the heat radiating assembly of the light source includes a plurality of elongate rods, and the second side of the support base has a peripheral wall provided with a plurality of heat conducting grooves to receive the elongate rods of the heat radiating assembly. Preferably, the heat conducting groove of the support base has a substantially honeycomb shape, and the heat radiating assembly of the light source has a substantially honeycomb shape. The heat radiating fins of the housing unit surround a peripheral wall of the housing, and the pointed portions of the heat radiating fins surround a peripheral wall of the opening of the receiving chamber. The heat radiating fins of the housing unit are mounted outside of the housing, and the housing of the housing unit is located between the heat radiating fins of the housing unit and the light source. The support base is surrounded by the pointed portions of the heat radiating fins. The heat radiating assembly of the light source is extended into the receiving chamber of the housing, and the heat conducting plate of the light source is extended into the receiving chamber of the housing.

The primary objective of the present invention is to provide a lamp having an enhanced heat radiating effect.

According to the primary objective of the present invention, the support base of the light source is surrounded by the pointed portions of the heat radiating fins so that a part of the heat produced by the light emitting members of the support base is transferred by and carried away from the housing of the housing unit rapidly to enhance the heat radiating effect.

According to another objective of the present invention, the heat produced by the light emitting members of the support base is in turn delivered through and transferred by the heat conducting groove of the support base, the heat radiating assembly of the light source, the heat conducting plate of the light source and the housing of the housing unit to the heat radiating fins of the housing unit and is carried outwardly from the heat radiating fins of the housing unit so that the heat is dissipated rapidly and smoothly so as to enhance the heat radiating efficiency.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
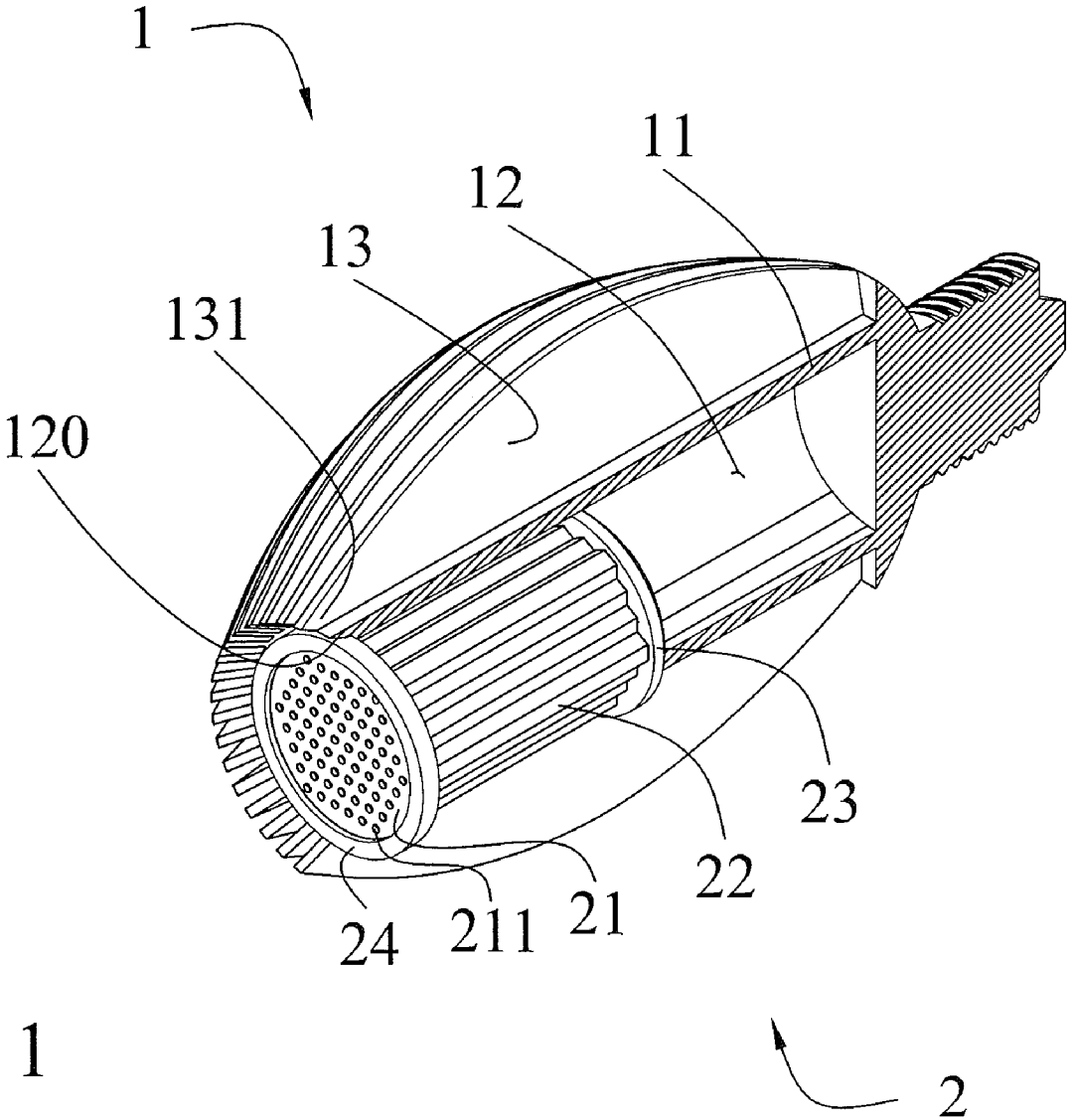
FIG. 1 is a perspective broken cross-sectional view of a lamp in accordance with the preferred embodiment of the present invention.
Figure 2:
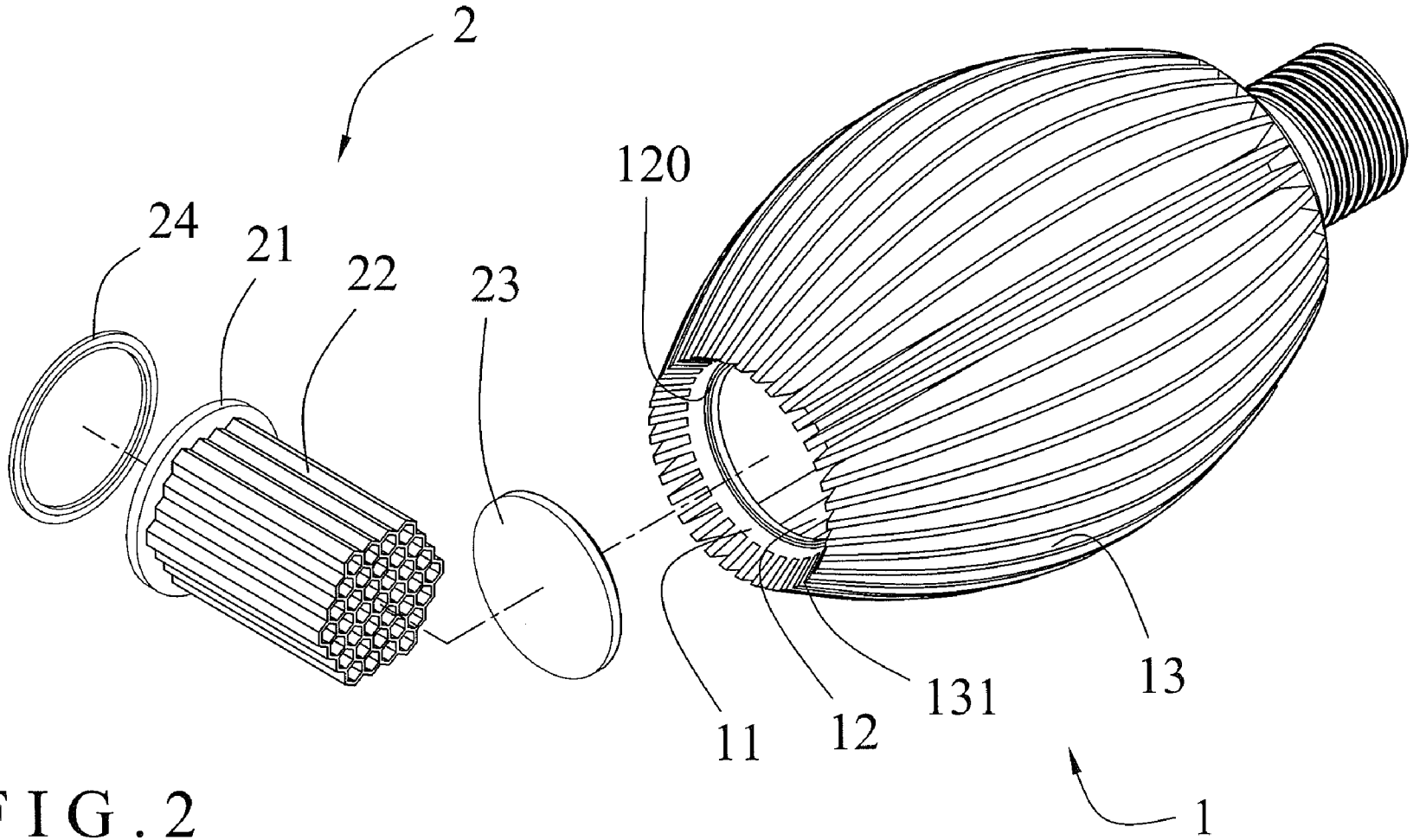
FIG. 2 is an exploded perspective view of the lamp as shown in FIG. 1.
Figure 3:
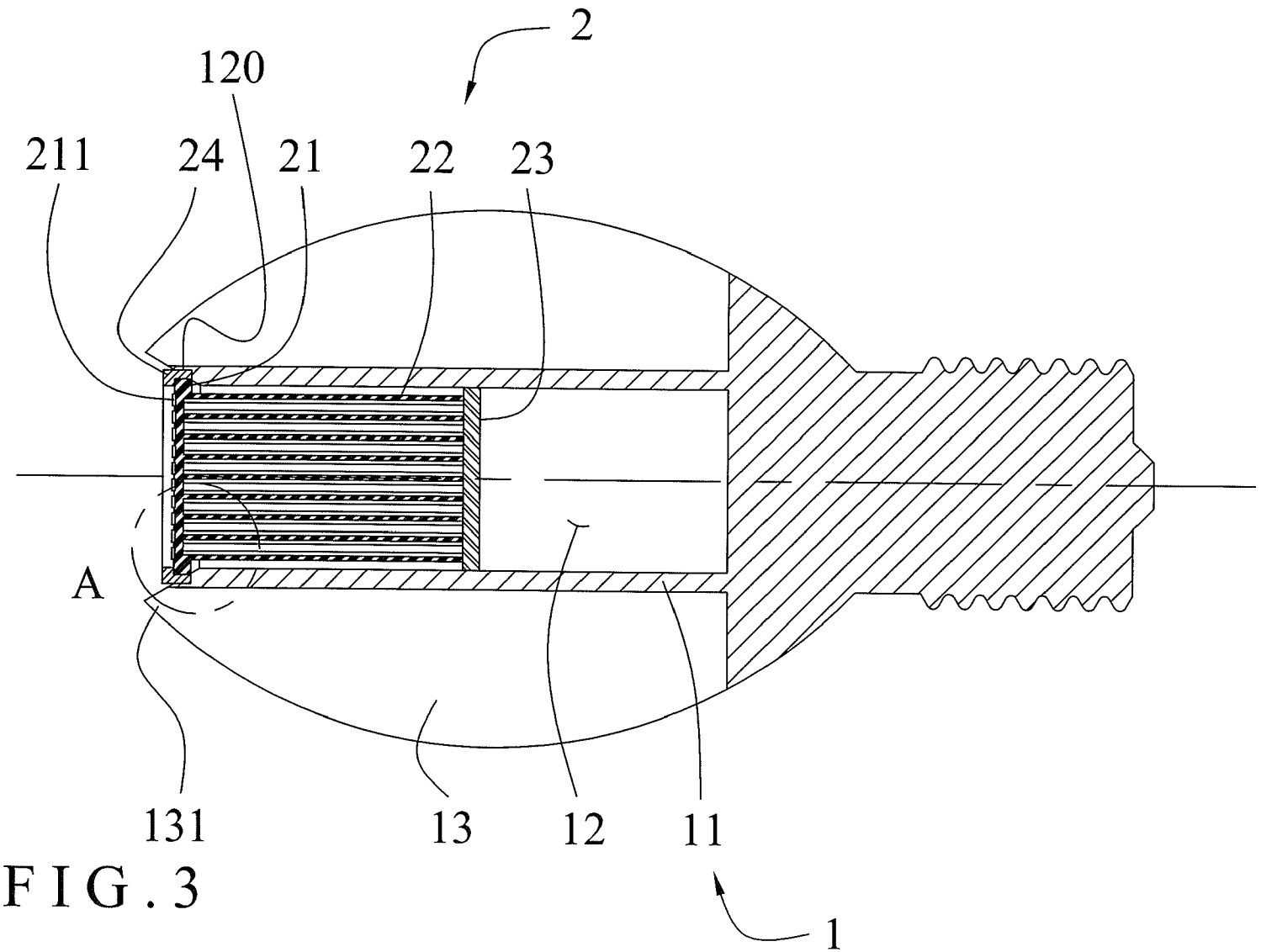
FIG. 3 is a front cross-sectional view of the lamp as shown in FIG. 1.
Figure 4:
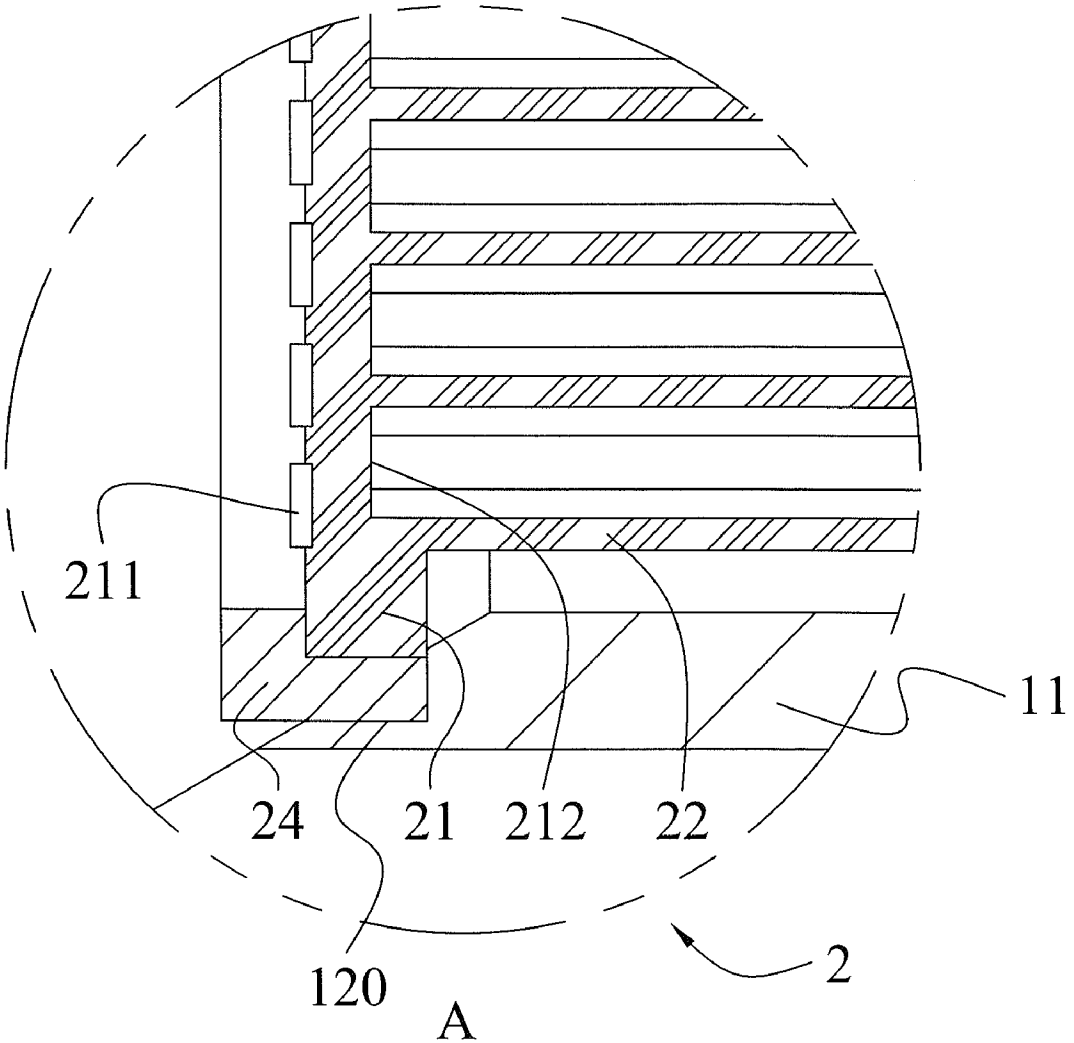
FIG. 4 is a locally enlarged view of the lamp taken along a circle "A" as shown in FIG. 1.

Referring to the drawings and initially to FIGS. 1-4, a lamp in accordance with the preferred embodiment of the present invention comprises a housing unit 1 and a light source 2 mounted on the housing unit 1.

The housing unit 1 includes a housing 11 and a plurality of heat radiating fins 13 mounted on the housing 11. The housing 11 of the housing unit 1 has a substantially cylindrical shape and has an inside provided with a receiving chamber 12. The receiving chamber 12 of the housing 11 has a substantially circular shape and has an end provided with an opening 120. The heat radiating fins 13 of the housing unit 1 are mounted outside of the housing 11. The heat radiating fins 13 of the housing unit 1 are spaced from each other and surround a peripheral wall of the housing 11. Each of the heat radiating fins 13 of the housing unit 1 extends in a longitudinal direction of the housing 11 and has an end provided with a pointed portion 131. The pointed portions 131 of the heat radiating fins 13 are spaced from each other and surround a peripheral wall of the opening 120 of the receiving chamber 12.

The light source 2 is received in the receiving chamber 12 of the housing 11 so that the housing 11 of the housing unit 1 is located between the heat radiating fins 13 of the housing unit 1 and the light source 2. The light source 2 includes a support base 21 having a first side provided with a plurality of light emitting members 211 exposed outwardly from the receiving chamber 12 of the housing 11, a heat radiating assembly 22 having a first end mounted on a second side of the support base 21 and a heat conducting plate 23 mounted on a second end of the heat radiating assembly 22.

The support base 21 of the light source 2 has a substantially circular shape. The support base 21 of the light source 2 is located in the opening 120 of the receiving chamber 12 and surrounded by the pointed portions 131 of the heat radiating fins 13. The second side of the support base 21 has a peripheral wall provided with a heat conducting groove 212 (see FIG. 4) to receive the first end of the heat radiating assembly 22. Preferably, the heat conducting groove 212 of the support base 21 has a substantially honeycomb shape. Each of the light emitting members 211 of the support base 21 is a light emitting diode (LED). Each of the light emitting members 211 of the support base 21 is surrounded by the pointed portions 131 of the heat radiating fins 13 and exposed outwardly from the opening 120 of the receiving chamber 12. The heat radiating assembly 22 of the light source 2 is extended into the receiving chamber 12 of the housing 11 and is located between the support base 21 and the heat conducting plate 23. Preferably, the heat radiating assembly 22 of the light source 2 is made of a metal, such as copper, and has a substantially honeycomb shape. The heat conducting plate 23 of the light source 2 is extended into the receiving chamber 12 of the housing 11 and is in contact with the housing 11 of the housing unit 1. Preferably, the heat conducting plate 23 of the light source 2 is made of a metal, such as copper, and has a substantially circular shape.

The light source 2 further includes a retaining ring 24 mounted on the support base 21 and located in the opening 120 of the receiving chamber 12 so that the retaining ring 24 of the light source 2 is located between the support base 21 of the light source 2 and the housing 11 of the housing unit 1.

When in use, the heat produced by the light emitting members 211 of the support base 21 is in turn delivered through and transferred by the heat conducting groove 212 of the support base 21, the heat radiating assembly 22 of the light source 2, the heat conducting plate 23 of the light source 2 and the housing 11 of the housing unit 1 to the heat radiating fins 13 of the housing unit 1 and is carried outwardly from the heat radiating fins 13 of the housing unit 1 so as to achieve a heat dissipation effect.

Figure 5:
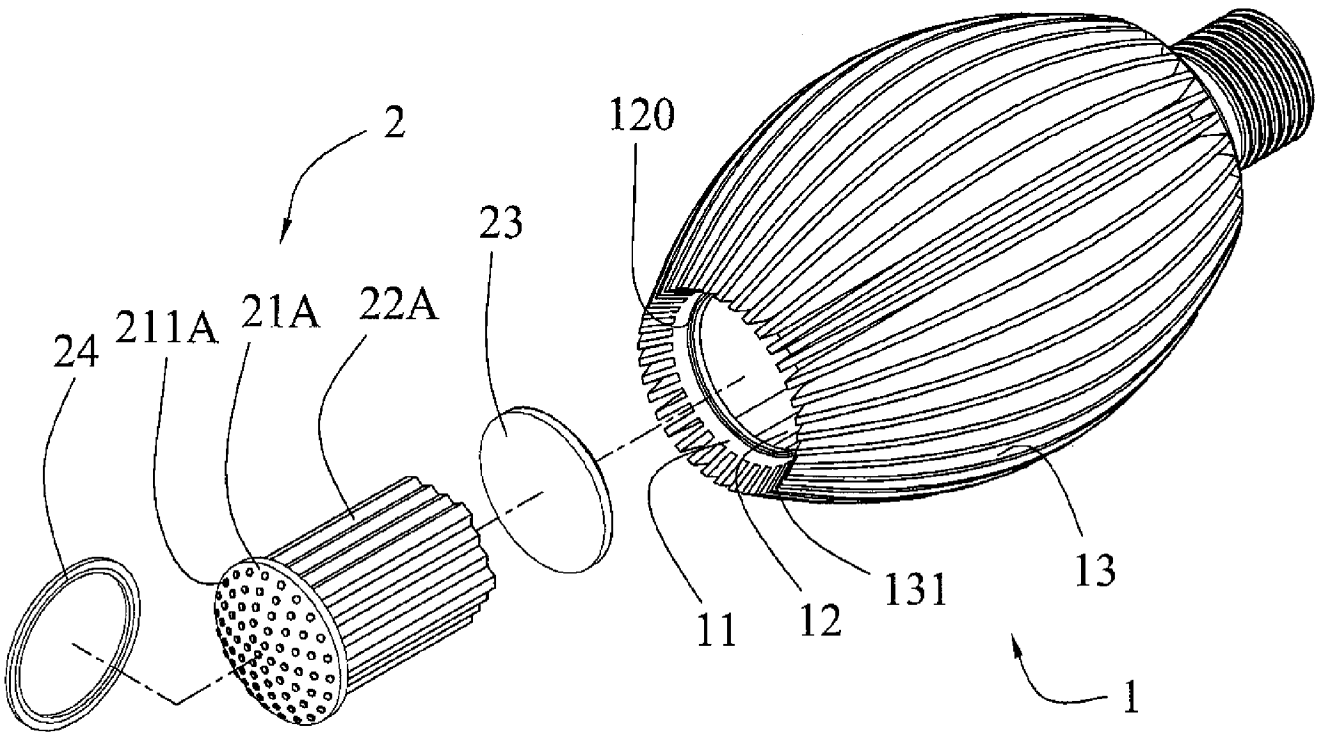
FIG. 5 is an exploded perspective view of a lamp in accordance with another preferred embodiment of the present invention.
Figure 6:
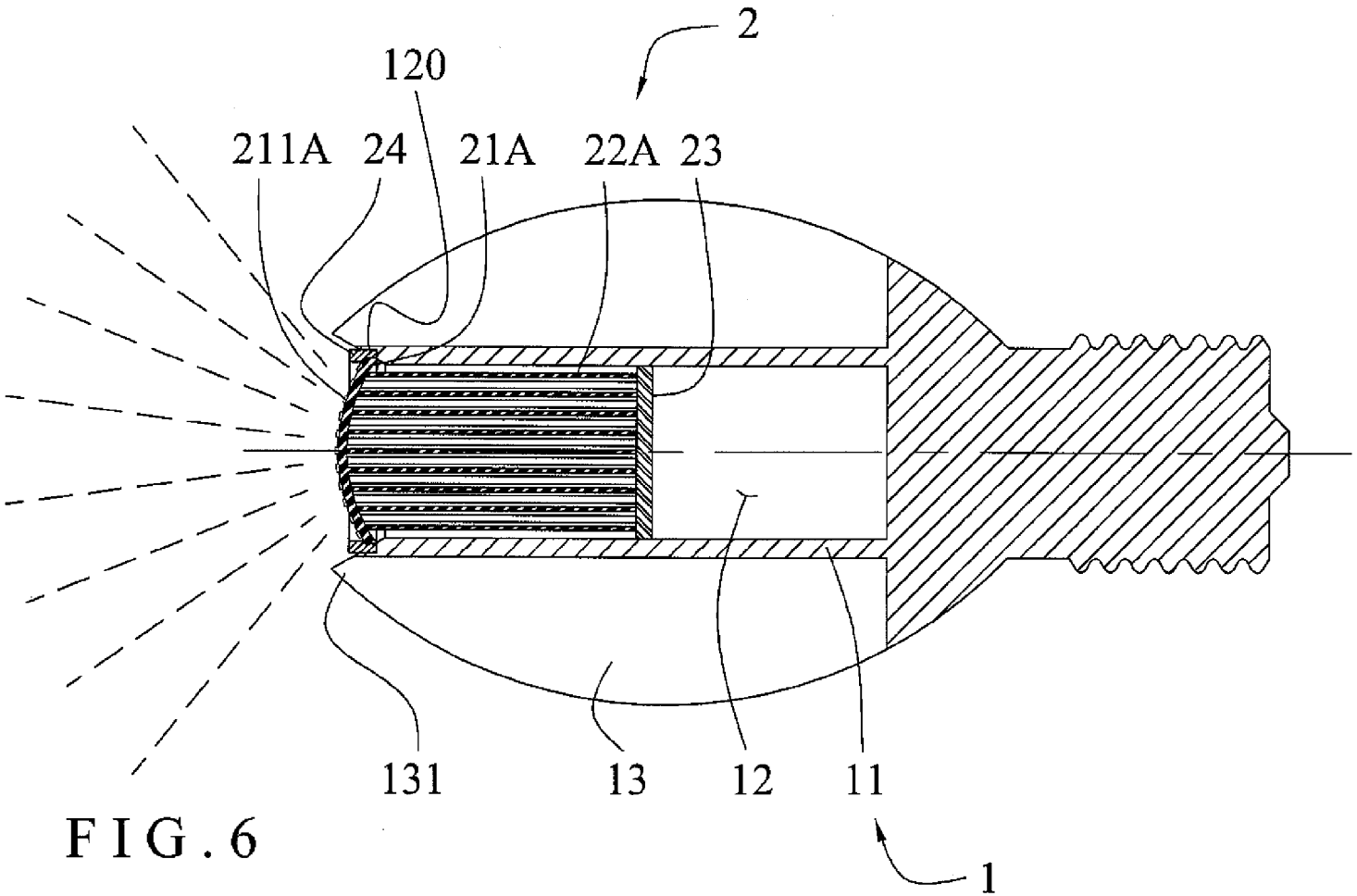
FIG. 6 is a front cross-sectional assembly view of the lamp as shown in FIG. 5.

Referring to FIGS. 5 and 6, the heat radiating assembly 22A is connected with the support base 21A, and the support base 21A of the light source 2 has a substantially convex shape and protrudes outwardly from the opening 120 of the receiving chamber 12 to increase the projecting angle of the light emitting members 211A.

Figure 7:
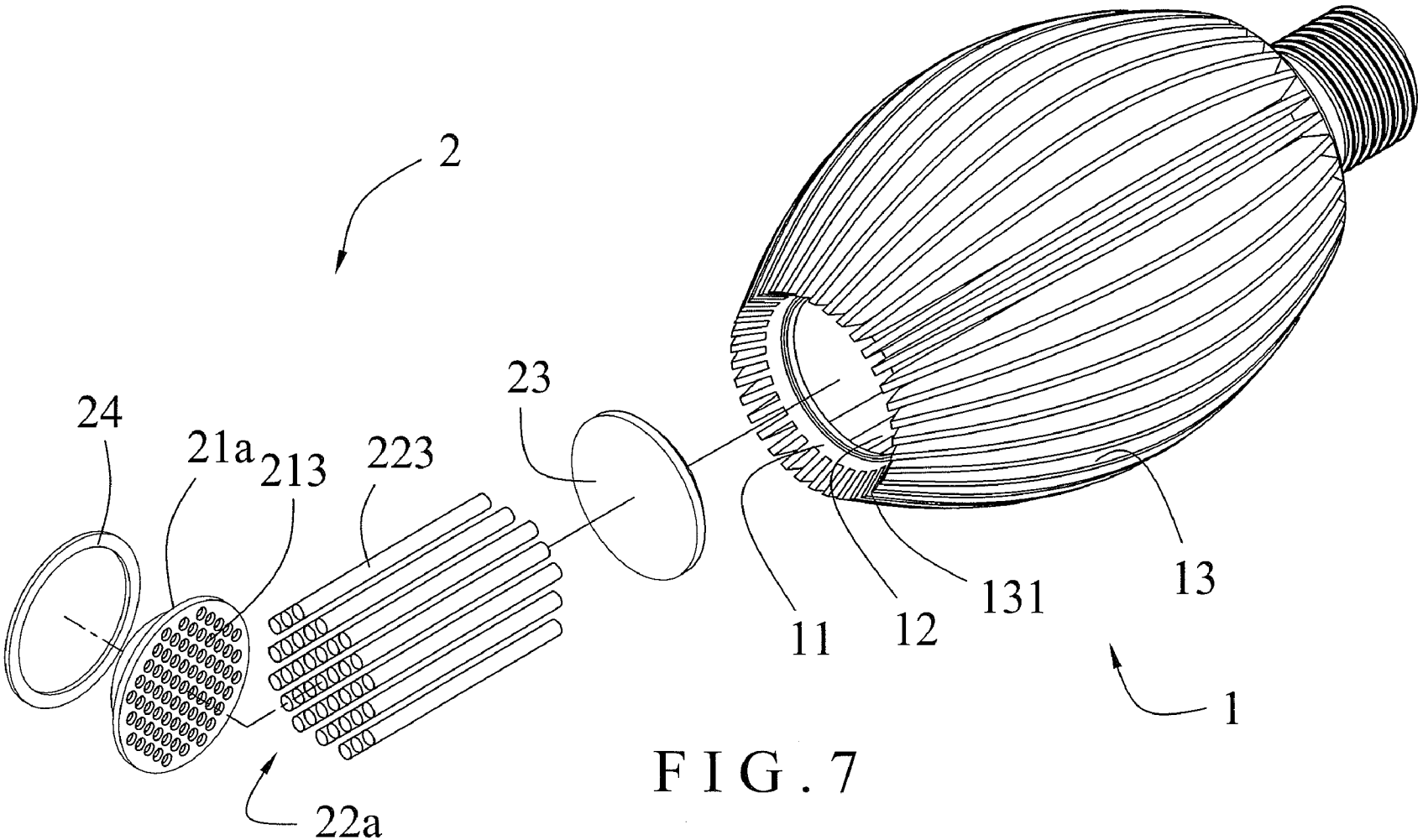
FIG. 7 is an exploded perspective view of a lamp in accordance with another preferred embodiment of the present invention.

Referring to FIG. 7, the heat radiating assembly 22*a* of the light source 2 includes a plurality of elongate rods 223, and the second side of the support base 21*a* has a peripheral wall provided with a plurality of heat conducting grooves 213 to receive the elongate rods 223 of the heat radiating assembly 22*a*.

Accordingly, the support base 21 of the light source 2 is surrounded by the pointed portions 131 of the heat radiating fins 13 so that a part of the heat produced by the light emitting members 211 of the support base 21 is transferred by and carried away from the housing 11 of the housing unit 1 rapidly to enhance the heat radiating effect. In addition, the heat produced by the light emitting members 211 of the support base 21 is in turn delivered through and transferred by the heat conducting groove 212 (or the heat conducting grooves 213) of the support base 21, the heat radiating assembly 22 of the light source 2, the heat conducting plate 23 of the light source 2 and the housing 11 of the housing unit 1 to the heat radiating fins 13 of the housing unit 1 and is carried outwardly from the heat radiating fins 13 of the housing unit 1 so that the heat is dissipated rapidly and smoothly so as to enhance the heat radiating efficiency.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A lamp, comprising:

a housing unit including:

a housing with an inside defining a receiving chamber having an end provided with an opening, and a plurality of heat radiating fins each having an end provided with a pointed portion, the heat radiating fins mounted on the housing;

a light source mounted on the housing unit including:

a support base having a first side provided with a plurality of light emitting members exposed outwardly from the receiving chamber of the housing, a heat radiating assembly having a first end mounted on a second side of the support base, and a heat conducting plate mounted on a second end of the heat radiating assembly;

wherein the light source is received in the receiving chamber of the housing, such that the support base of the light source is located in the opening of the receiving chamber, and the support base of the light source is surrounded by the pointed portions of the heat radiating fins.

2. The lamp of claim 1, wherein the heat radiating assembly of the light source includes a plurality of elongate rods;

the second side of the support base has a peripheral wall provided with a plurality of heat conducting grooves to receive the elongate rods of the heat radiating assembly.

3. The lamp of claim 1, wherein the housing of the housing unit has a substantially cylindrical shape;

the receiving chamber of the housing has a substantially circular shape;

the support base of the light source has a substantially circular shape;

the heat conducting plate of the light source has a substantially circular shape.

4. The lamp of claim 1, wherein the heat radiating fins of the housing unit are spaced from each other;

the pointed portions of the heat radiating fins are spaced from each other.

5. The lamp of claim 1, wherein the heat radiating fins of the housing unit surround a peripheral wall of the housing;

the pointed portions of the heat radiating fins surround a peripheral wall of the opening of the receiving chamber.

6. The lamp of claim 1, wherein each of the heat radiating fins of the housing unit extends in a longitudinal direction of the housing.

7. The lamp of claim 1, wherein the heat radiating fins of the housing unit are mounted outside of the housing;

the housing of the housing unit is located between the heat radiating fins of the housing unit and the light source.

8. The lamp of claim 1, wherein each of the light emitting members of the support base is surrounded by the pointed portions of the heat radiating fins.

9. The lamp of claim 1, wherein each of the light emitting members of the support base is exposed outwardly from the opening of the receiving chamber.

10. The lamp of claim 1, wherein the heat radiating assembly of the light source is extended into the receiving chamber of the housing;

the heat conducting plate of the light source is extended into the receiving chamber of the housing.

11. The lamp of claim 1, wherein the heat radiating assembly of the light source is located between the support base and the heat conducting plate;

the heat conducting plate of the light source is in contact with the housing of the housing unit.

12. The lamp of claim 1, wherein the support base of the light source has a substantially convex shape.

13. The lamp of claim 12, wherein the support base of the light source protrudes outwardly from the opening of the receiving chamber.

14. A lamp, comprising:

a housing unit including:

a housing with an inside defining a receiving chamber having an end provided with an opening, and a plurality of heat radiating fins each having an end provided with a pointed portion, the heat radiating fins mounted on the housing;

a light source mounted on the housing unit including:

a support base having a first side provided with a plurality of light emitting members exposed outwardly from the receiving chamber of the housing, a heat radiating assembly having a first end mounted on a second side of the support base, and a heat conducting plate mounted on a second end of the heat radiating assembly;

wherein the light source is received in the receiving chamber of the housing, such that the support base of the light source is located in the opening of the receiving chamber wherein the light source further includes a retaining ring mounted on the support base and located in the opening of the receiving chamber.

15. The lamp of claim 14, wherein the retaining ring of the light source is located between the support base of the light source and the housing of the housing unit.

16. A lamp, comprising:

a housing unit including:

a housing with an inside defining a receiving chamber having an end provided with an opening, and a plurality of heat radiating fins each having an end provided with a pointed portion, the heat radiating fins mounted on the housing;

a light source mounted on the housing unit including:

a support base having a first side provided with a plurality of light emitting members exposed outwardly from the receiving chamber of the housing, a heat radiating assembly having a first end mounted on a second side of the support base, and a heat conducting plate mounted on a second end of the heat radiating assembly;

the second side of the support base has a peripheral wall provided with a heat conducting groove to receive the first end of the heat radiating assembly;

the heat conducting groove of the support base has a substantially honeycomb shape; and the heat radiating assembly of the light source has a substantially honeycomb shape.

* * * * *